United States Patent [19]

Rosenthal

[11] Patent Number: 5,059,049

[45] Date of Patent: Oct. 22, 1991

[54] DEVICE FOR ADJUSTMENT OF A PRINTER

[75] Inventor: Manfred Rosenthal, Kirchen-Freusburg, Fed. Rep. of Germany

[73] Assignee: U.S. Philips Corporation, New York, N.Y.

[21] Appl. No.: 487,674

[22] Filed: Mar. 1, 1990

[30] Foreign Application Priority Data

Mar. 2, 1989 [DE] Fed. Rep. of Germany ..... 3906611

[51] Int. Cl.[5] ..... B41J 11/48

[52] U.S. Cl. ..... 400/605; 400/616; 400/625; 400/637.2; 400/613.1

[58] Field of Search ..... 400/605, 637.2, 616, 400/616.1, 616.2, 624, 625, 629, 636, 636.1; 271/3, 9; 226/101, 74

[56] References Cited

U.S. PATENT DOCUMENTS

| | | | |
|---|---|---|---|
| 4,577,984 | 3/1986 | Yamamoto et al. | 400/625 |
| 4,688,957 | 8/1987 | Prevignano | 400/605 |
| 4,756,636 | 7/1988 | Maruyama et al. | 400/605 |
| 4,808,019 | 2/1989 | Olson et al. | 400/605 |
| 4,834,277 | 5/1989 | Gomoll et al. | 226/101 |
| 4,875,790 | 10/1989 | Karube et al. | 400/616.2 |
| 4,913,576 | 4/1990 | Yokol | 400/605 |

FOREIGN PATENT DOCUMENTS

| | | |
|---|---|---|
| 0197340 | 10/1986 | Fed. Rep. of Germany . |
| 3607080 | 9/1987 | Fed. Rep. of Germany . |
| 2716396 | 10/1987 | Fed. Rep. of Germany . |
| 2162795 | 2/1986 | United Kingdom . |

*Primary Examiner*—Eugene H. Eickholt
*Attorney, Agent, or Firm*—William Squire

[57] ABSTRACT

For a simple adjustment of a printer from paper sheet transport to endless paper transport mode and conversely, an adjustment assembly is adjustable through selective engagement by a ram of the print head carriage according to the carriage position and is in operative connection with an endless paper feed tractor, a paper path switch and pressure rollers to selectively place these elements in the sheet and endless paper feed modes.

25 Claims, 14 Drawing Sheets

DEVICE FOR ADJUSTMENT OF A PRINTER

Figure 1:
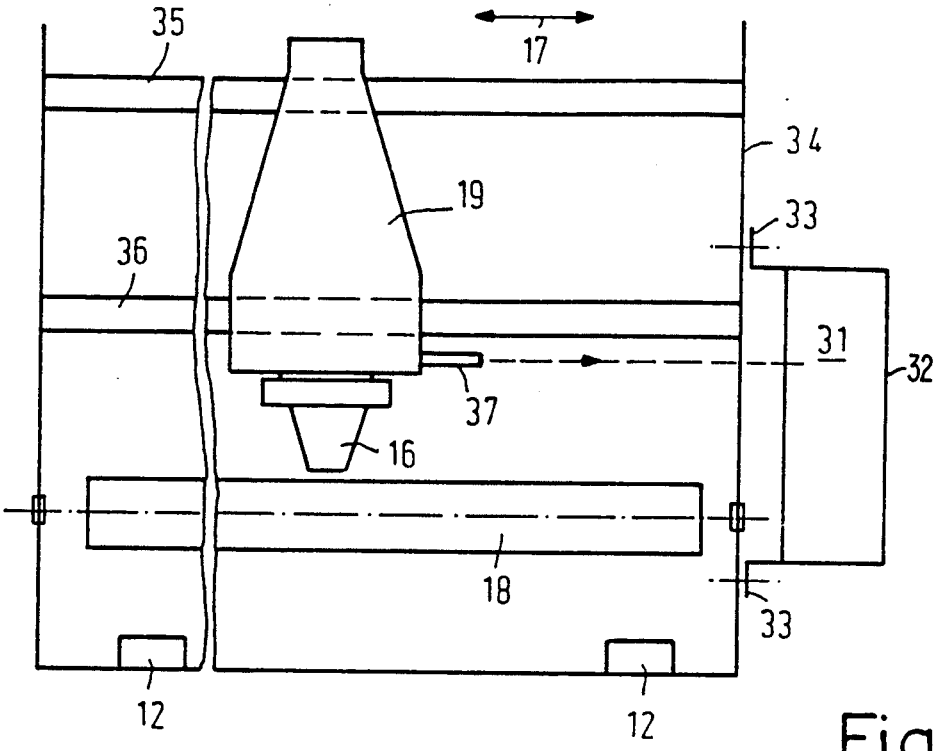

The invention relates to a device for adjusting printer feed modes comprising an endless paper feed tractor, a paper path switch and pressure/friction rollers for switching from paper sheet transport to endless paper transport and conversely.

German Patent Application P 38 07 807 discloses a printer, in which an adjustment takes place by means of a pivotable tractor and by means of an adjustable eccentric lever.

The invention has for its object to improve a device of the kind mentioned in the opening paragraph in such a manner that an automatic paper feed mode adjustment can take place by a simple actuation without an intervention in the printer being necessary. According to the invention, this object is achieved in that for feed mode adjustment purposes a separate paper feed adjustment assembly is provided, which is detachably connected to the printer carriage and is arranged so that upon actuation by displacement of the carriage to selectively engage or disengage the adjustment assembly, the assembly acts upon the tractor, the paper path switch and at least one pair of rollers. The adjustment assembly constitutes a separate unit, which is closed in itself and, after being engaged or disengaged from the printer, different associated adjustment members thereof are activated. The adjustment assembly is actuated from the outside, for example, through a ram attached to the printer carriage, and this actuation in accordance with the ram position then results automatically in a change-over of the mode of operation accompanied by a switching-on or switching-off of the tractor, an adjustment of the paper path switch position and a lifting and separation of the pressure rollers in the case of an endless paper transport in order to prevent a bulging in the case of multiple paper. The pressure rollers are lowered and engaged for feeding sheet paper in a second mode. Preferably, the adjustment assembly is arranged at an end of pressure roller. For setting the paper feed mode a displacement of the printer carriage which engages or disengages the ram with the adjustment assembly is sufficient.

Thus, an automatic change-over of the elements required for paper sheet transport and endless paper transport, respectively, is obtained without it being necessary to further intervene manually in the tractor.

The readjustment of the feed modes can take place in a simple manner in that a corresponding control command for displacement of the carriage and ram is given to the electronic system present in such printers. The readjustment itself then takes place through the adjustment assembly that is coupled or can be coupled to the printer. For this purpose, the adjustment assembly preferably comprises a lever mechanism for adjusting the path switch through a switch lever and for displacement of a toothed wheel that can be coupled to a motor drive and to the tractor through a spring-loaded adjustment lever; further, the adjustment assembly comprises a toothed wheel gear that be switched on through a coupling toothed wheel and comprises a follower element for lifting the pressure rollers through a roller lever. The adjustment assembly thus composed comprises in a compact construction on the one hand the elements required for coupling-in and coupling-out the tractor and on the other hand the elements required in the case of change-over of the paper paths for changing over the path switch on the one hand and for adjusting the pressure rollers on the other hand. In an embodiment of the invention, a disk-shaped follower element is rotatably journalled on a toothed wheel through a sliding coupling and has an eccentric toothed wheel, which during the lifting operation is in interdigitated operative connection with a stationary tooth segment only over a given path length. Thus, in the case of paper sheet transport the pressure rollers are pressed on the driving rollers (friction rollers) and that in the case of endless paper transport at the beginning of the transport the pressure rollers are first pressed, but these pressure rollers are lifted after a given period of time in order that a bulge-free endless paper transport is ensured.

An advantageous embodiment of the invention includes a lever mechanism which comprises a slide, which is adjustable by the ram of the carriage through a spring-loaded rotary lever, is spring-loaded in a direction transverse to the direction of adjustment, is pivotably connected at its outer end remote from the carriage to the adjustment lever and has a recess at its inner end facing the carriage on the front side for engagement of a lever switch; further, for engagement of the rotary lever a projection is provided on the lower side of the slide, which projection has on the side remote from the rotary lever a slope cooperating with a stop at the housing. Upon actuation of the slide, thus on the one hand a displacement of the coupling gear wheel takes place, by means of which the tractor can be coupled in or coupled out, while on the other hand the switch for changing over the paper path from endless paper transport to paper sheet transport and conversely is adjusted in a simple and reliable manner by means of the lever switch engaging the slide.

The device according to the invention is preferably characterized by a) a starting position via engagement of the ram with the adjustment assembly, in which the tractor is coupled in, the pressure rollers are first pressed and are lifted with delay after a starting time and the switch is in the position "endless paper transport", and b) a defined central position of the print head and carriage, in which the tractor is coupled out, the pressure rollers are pressed and the switch is in the position "paper sheet transport".

The adjustment assembly can be set by a single disengagement movement of the ram from the starting position to the central position and can be reset by again a single engagement movement from the central position to the starting position. Thus, in the central position the system is in the sheet feed mode and with the ram engaged with the adjustment assembly, the system is in the endless paper feed mode. The lever switch is located in the recess of the slide so that the slide is locked and remains in this position, even when the carriage with the ram is disengaged from the adjustment assembly when moved back into the printing position. In the starting position, however, the switch lever engages the front side of the slide, that is to say that the slide is unlocked and the paper path switch is now changed over to endless paper stacking.

The adjustment of the different modes of operation by means of a device according to the invention preferably takes place in such a manner that for obtaining the central position (paper sheet transport) the carriage is displaced over such a distance from the starting position that the switch lever slides into the recess of the slide and the slope is located immediately before a projection on the housing. For obtaining the starting position (endless paper transport), the carriage is displaced over such a distance that the slide is lifted through the slope by the projection on the housing and slides back into its starting position whilst the tractor is being coupled in through the coupling toothed wheel, on the one hand the switch lever being rotated out of the recess by a nose of the rotary lever and on the other hand the rotation of the follower element for the delayed lifting of the pressure rollers being made operative through the roller lever. For adjustment of the two gear positions, the carriage each time need be moved by only a single movement towards the adjustment assembly. A cooperation of the lever mechanism with the toothed wheels of the adjustment assembly is then obtained, the tractor being coupled in or out through the toothed wheel in dependence upon the mode of operation. With the paper sheet transport, the tractor is coupled out by disengaging the coupling toothed wheel. The lever switch is adjusted to paper sheet stacking by snapping into the recess of the slide. With the endless paper transport, the tractor is coupled in through the engaged toothed wheel. In this gear position, the paper path switch lever has left the recess so that the switch is now in the position "endless paper transport". Further, at the beginning of the endless paper transport, the toothed gear was made operative, the follower element, which serves to lift the pressure rollers for actuation of a roller lever, is first taken along by frictional coupling. After a short rotary movement, the eccentric toothed wheel of the follower element engages into the stationary tooth segment and a forced control of the follower element takes place.

A compact printer, which can readily be operated and adjusted, is thus obtained.

In the drawing, FIGS. 1 to 9 show diagrammatically an embodiment of the device according to the invention.

Figure 2B:
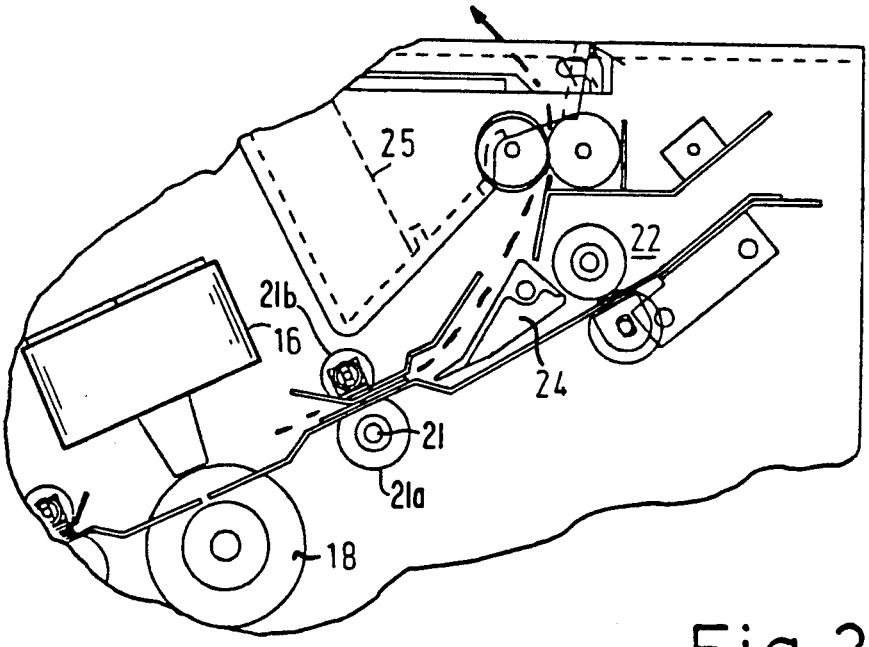
Figure 2A:
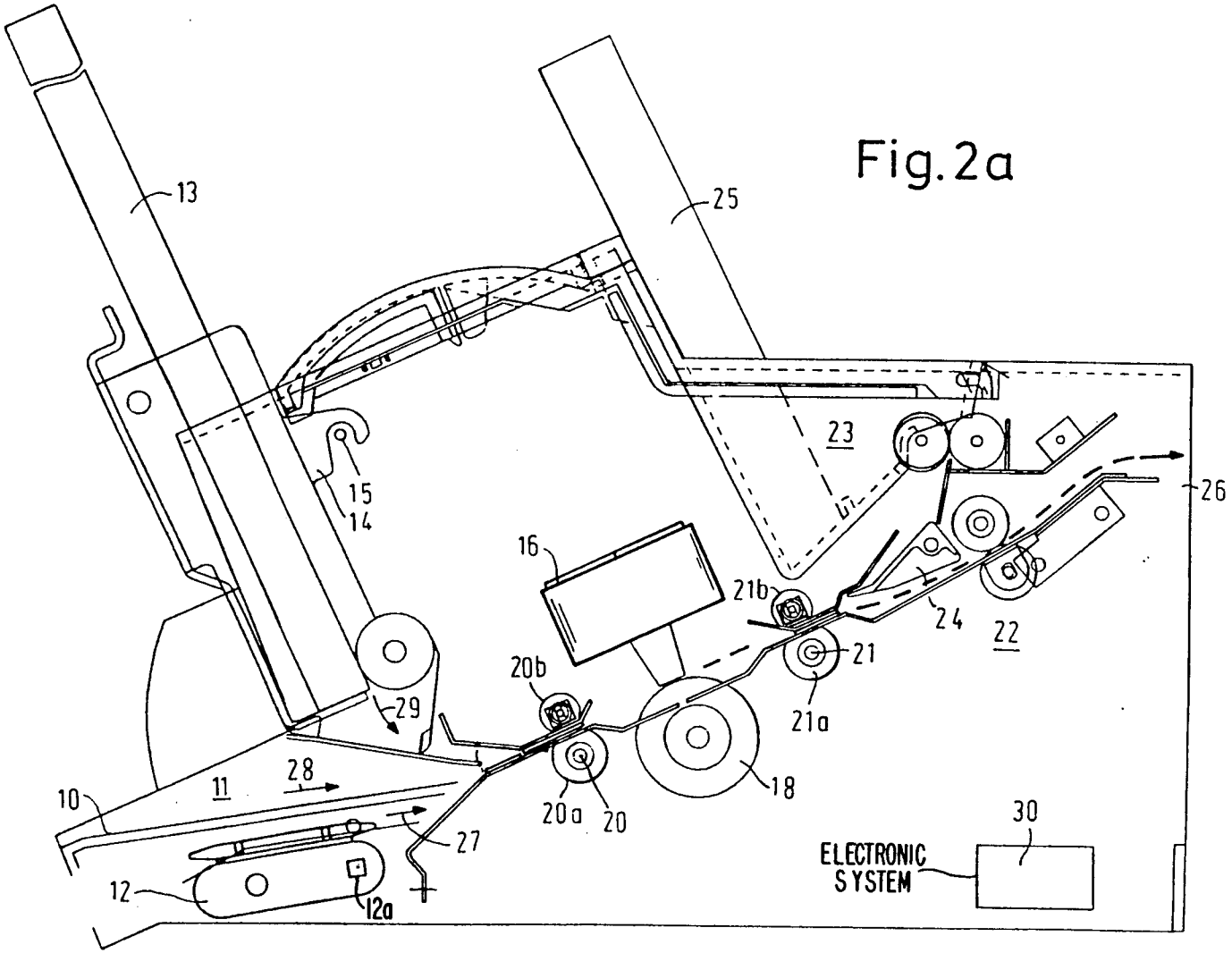
Figure 3A:
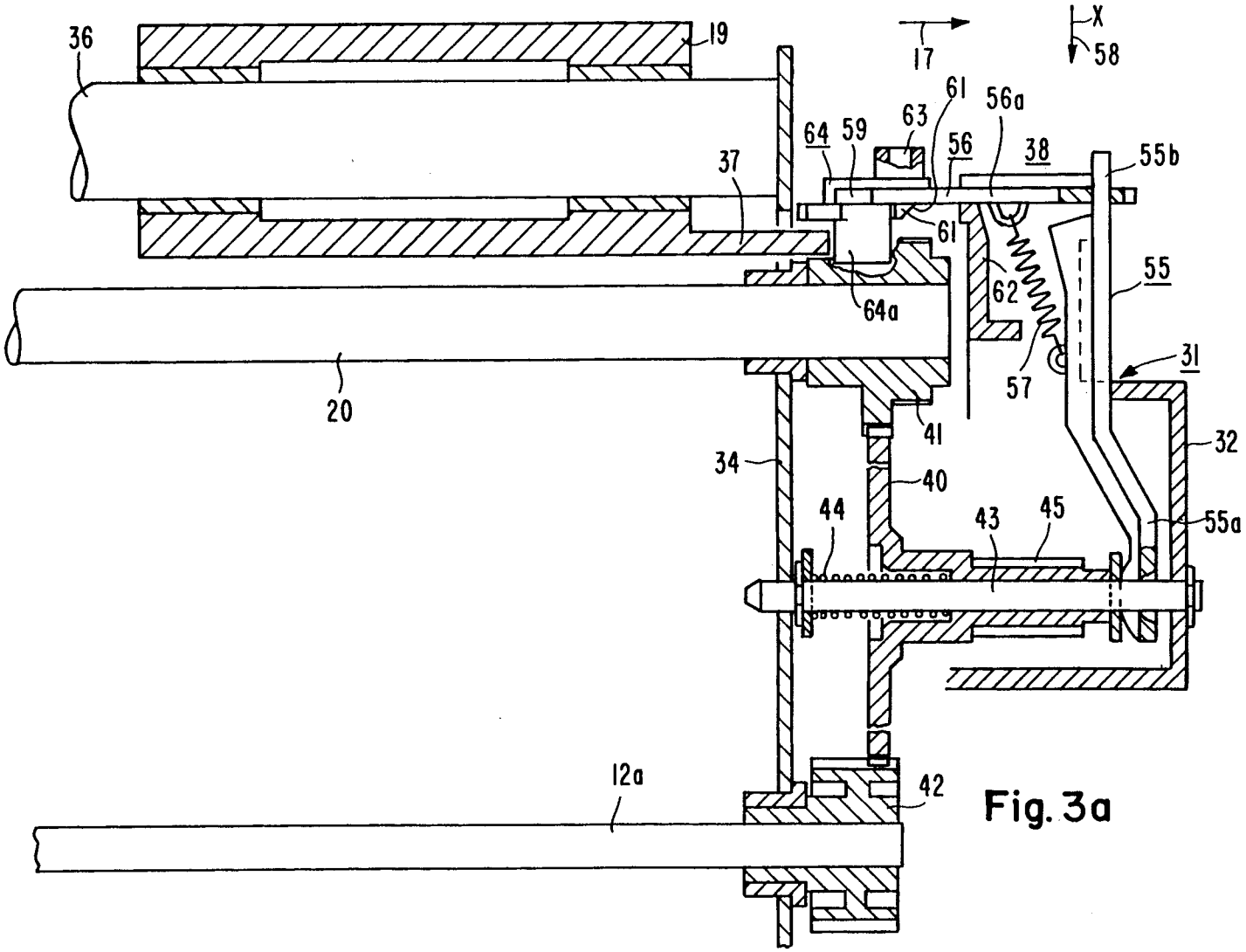
Figure 3B:
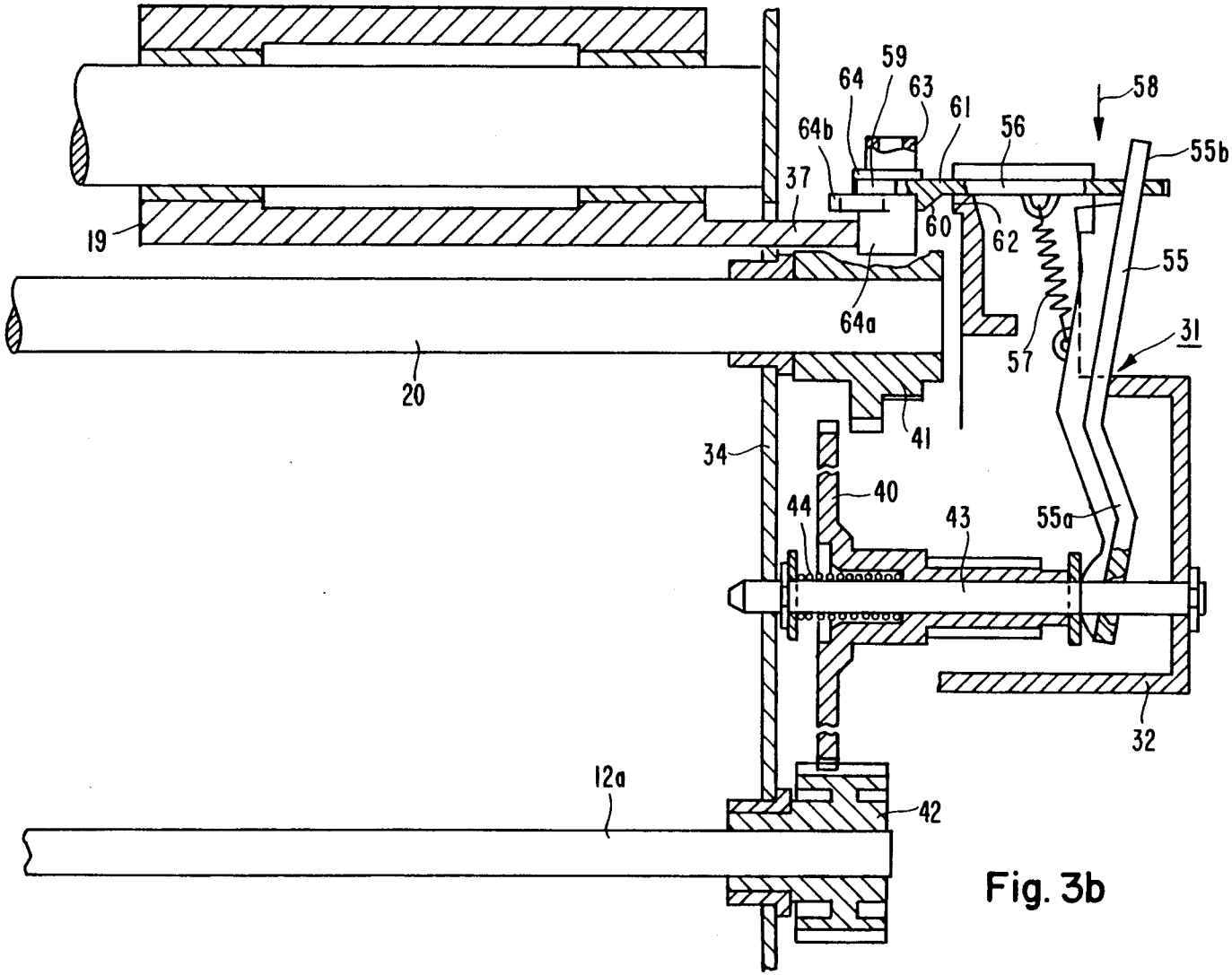
Figure 3C:
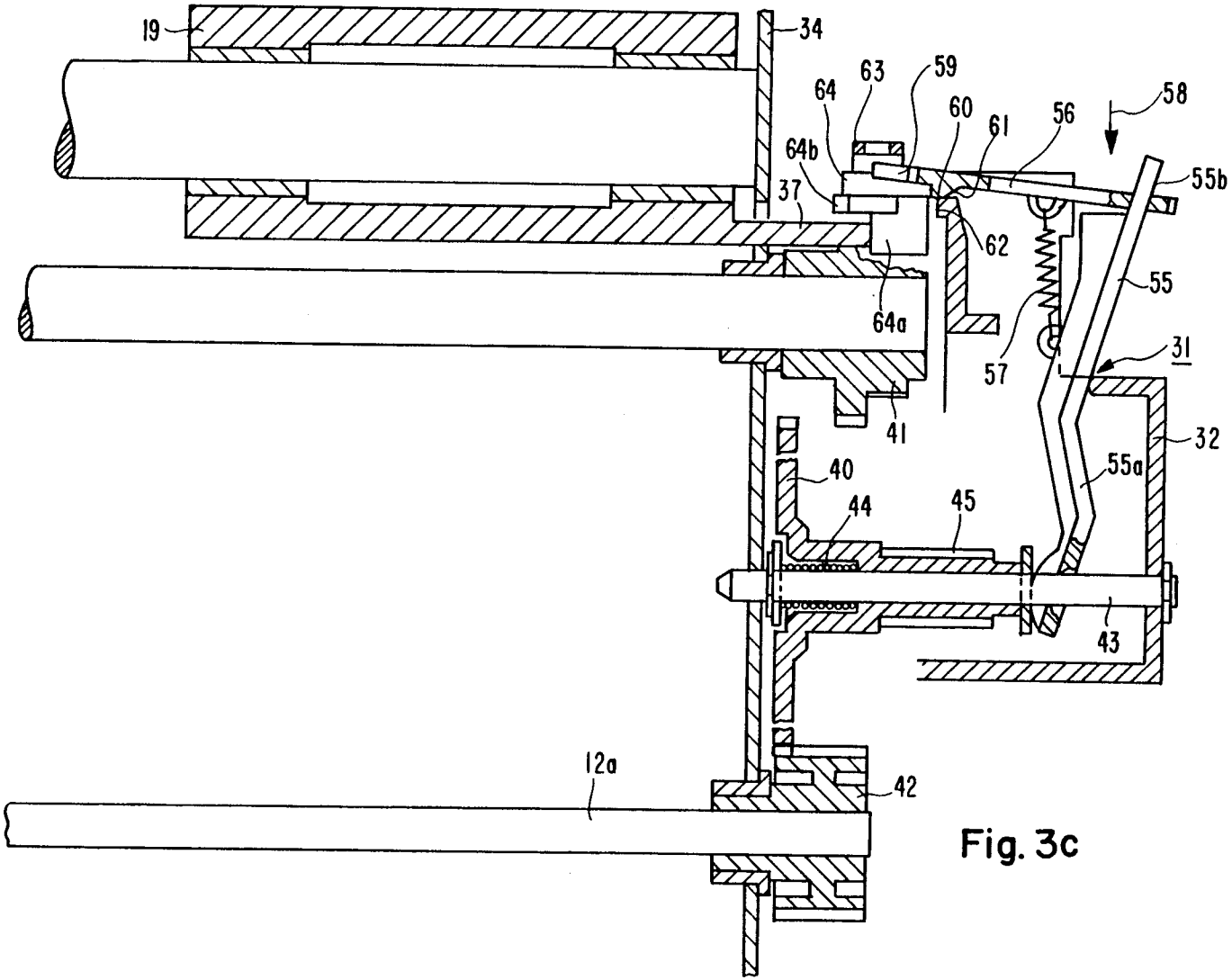
Figure 4A:
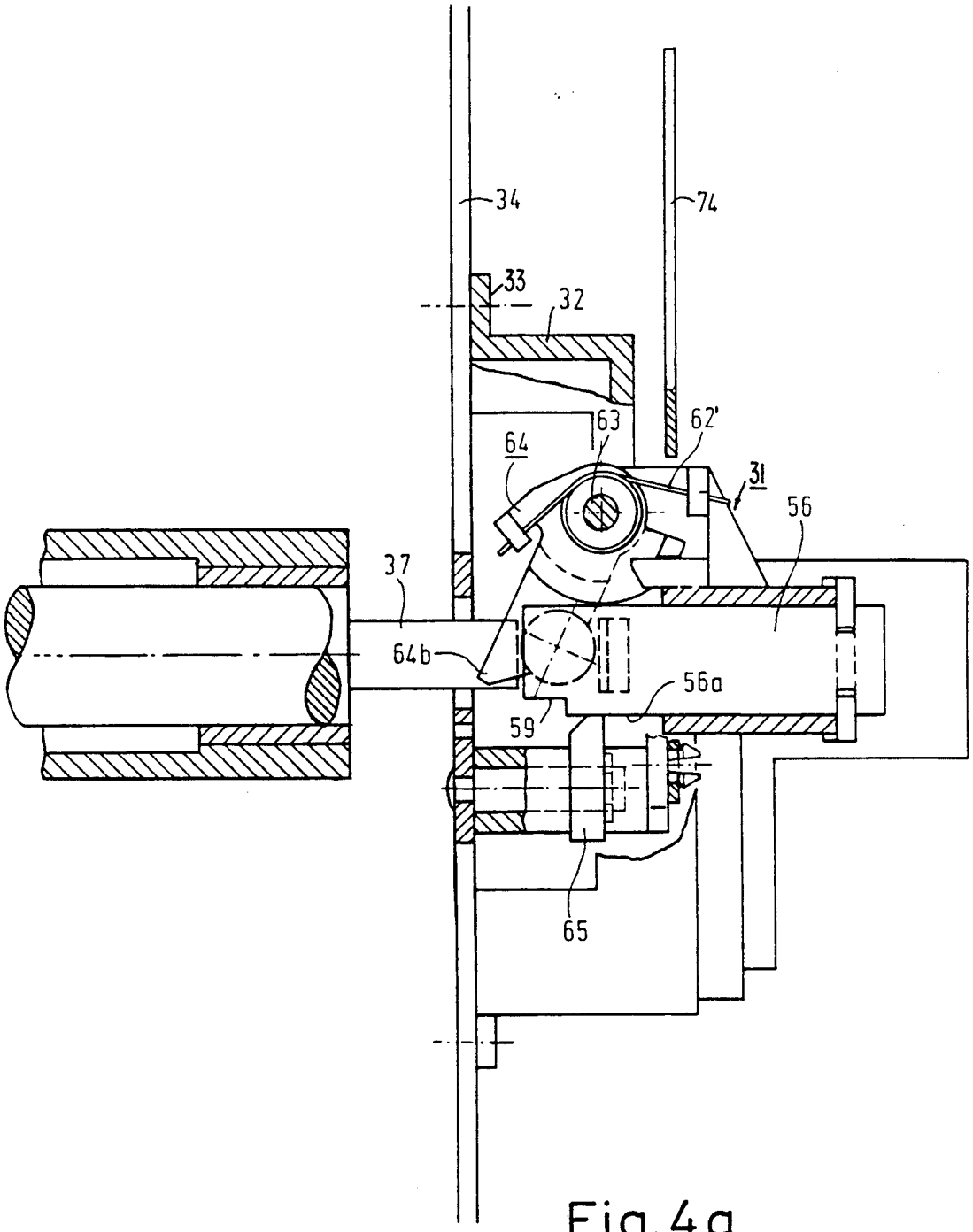
Figure 4B:
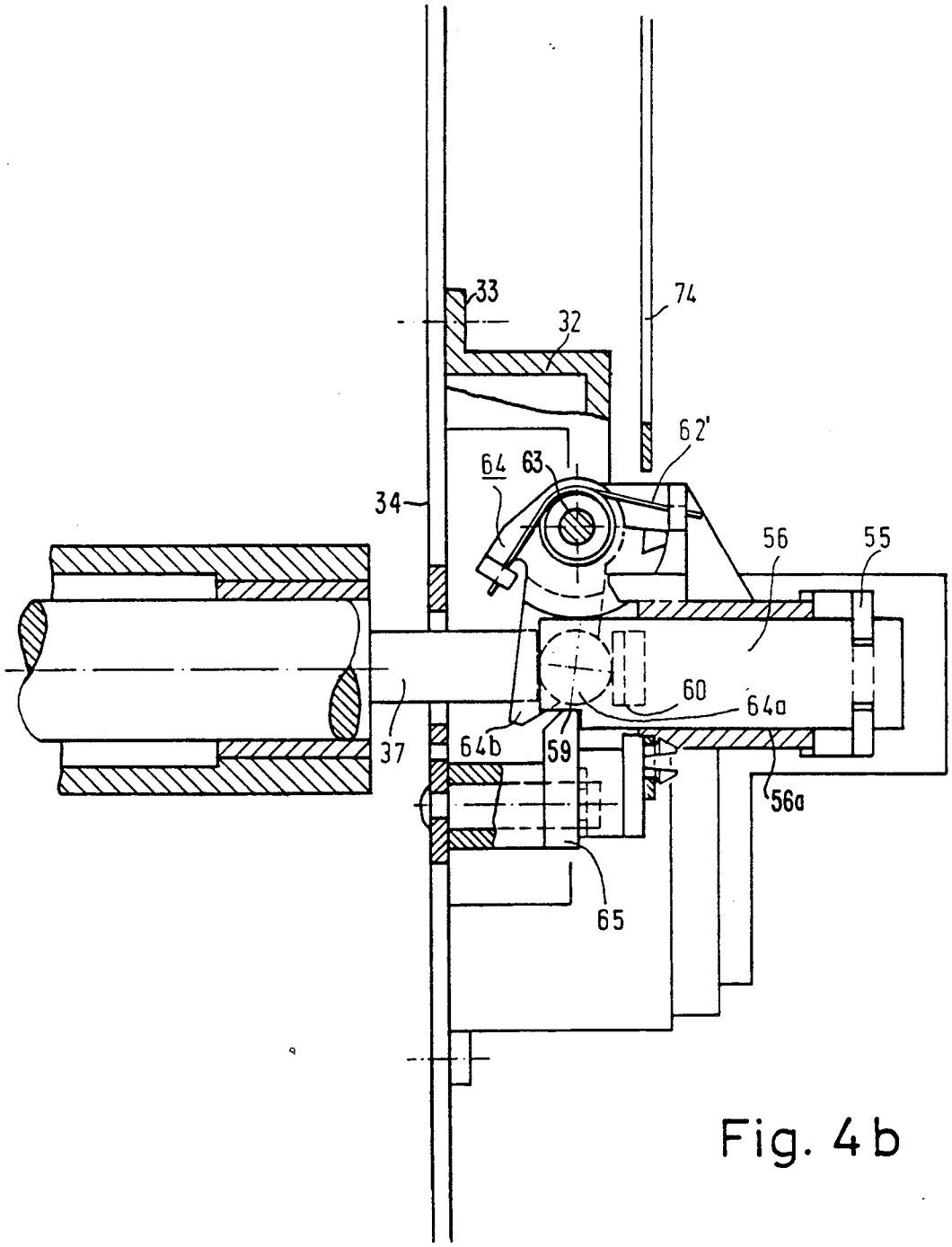
Figure 4C:
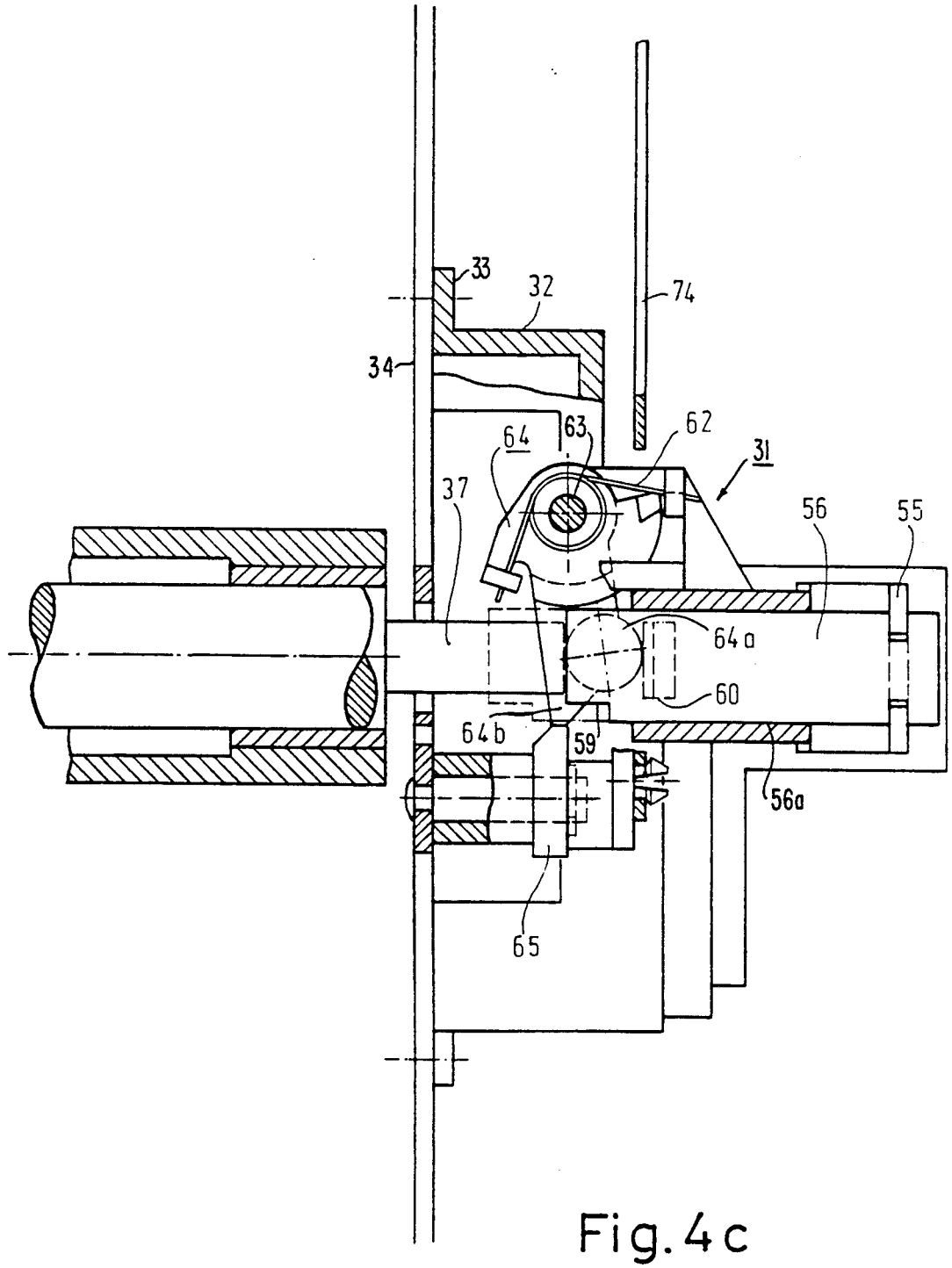

FIG. 1 shows in outline a front elevation of a needle printer with an adjustment assembly secured thereto, FIGS. 2*a* and *b* each show a side elevation from the righthand side of the printer with two different positions of a switch, FIGS. 3*a* to *c* show three positions of a lever mechanism of the adjustment gear each in a cut front elevation, FIGS. 4*a* to *c* show the same positions of the adjustment gear in a plan view from the direction X, FIGS. 3*a–c*

Figure 5A:
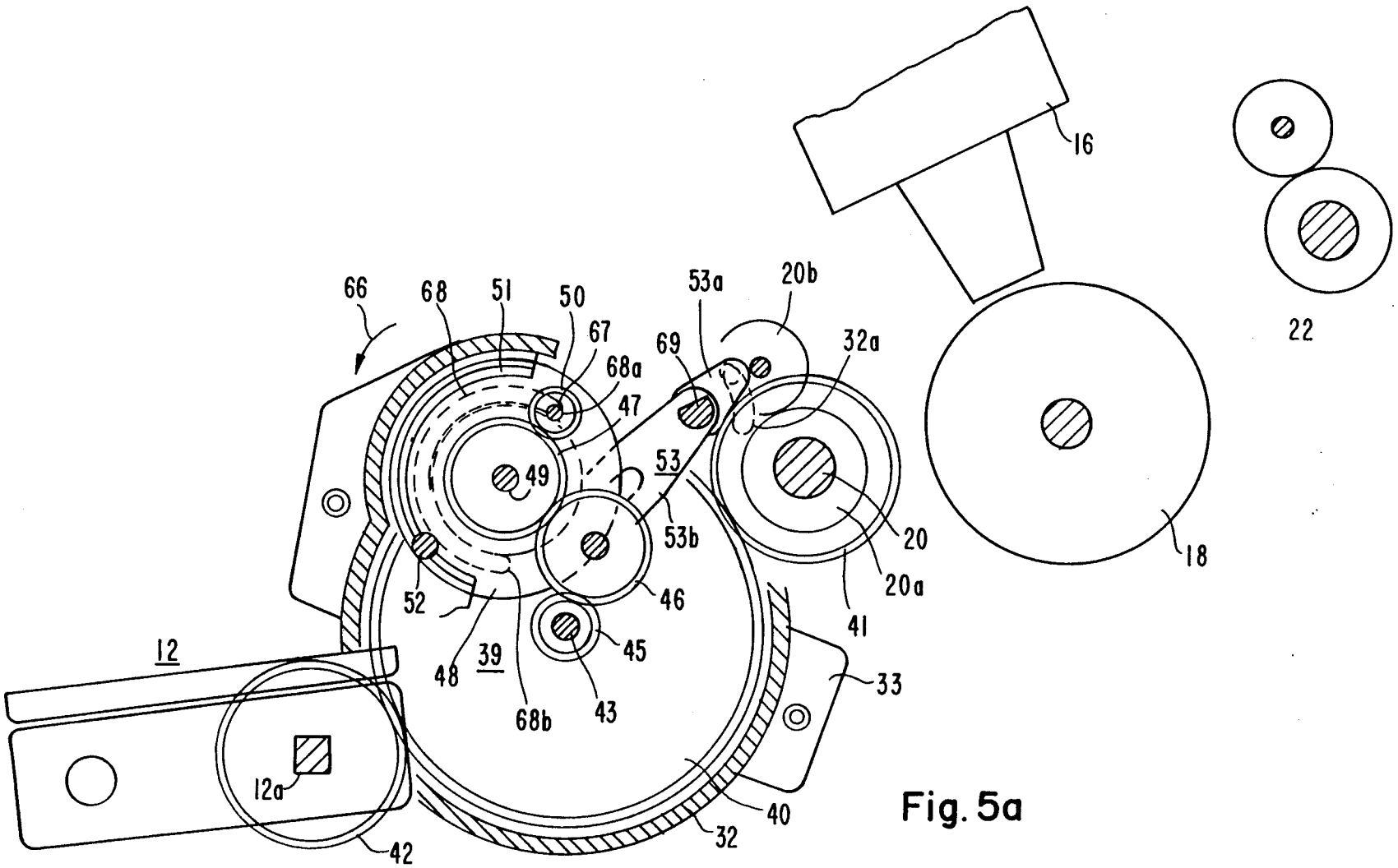
Figure 5B:
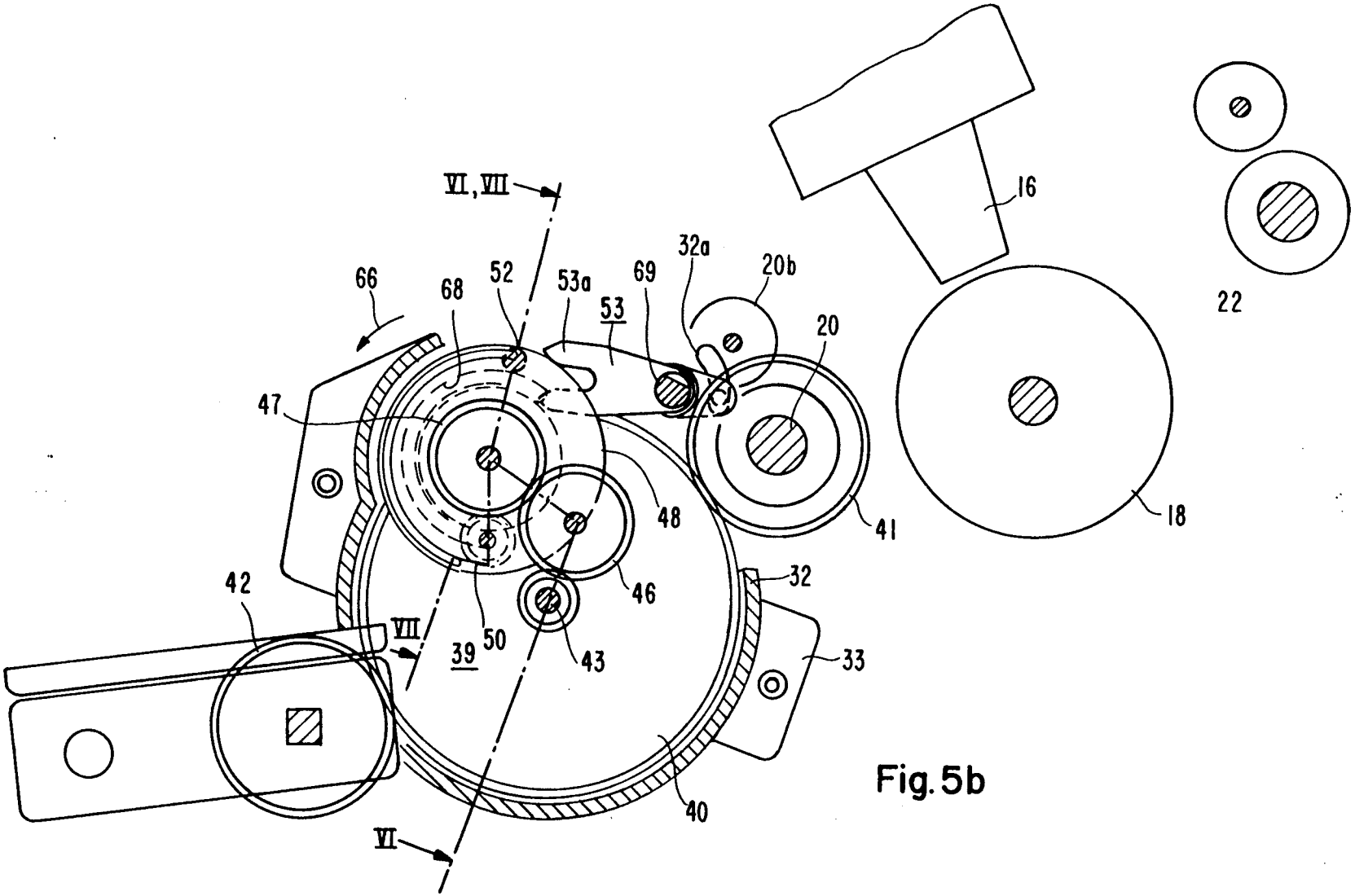
Figure 6:
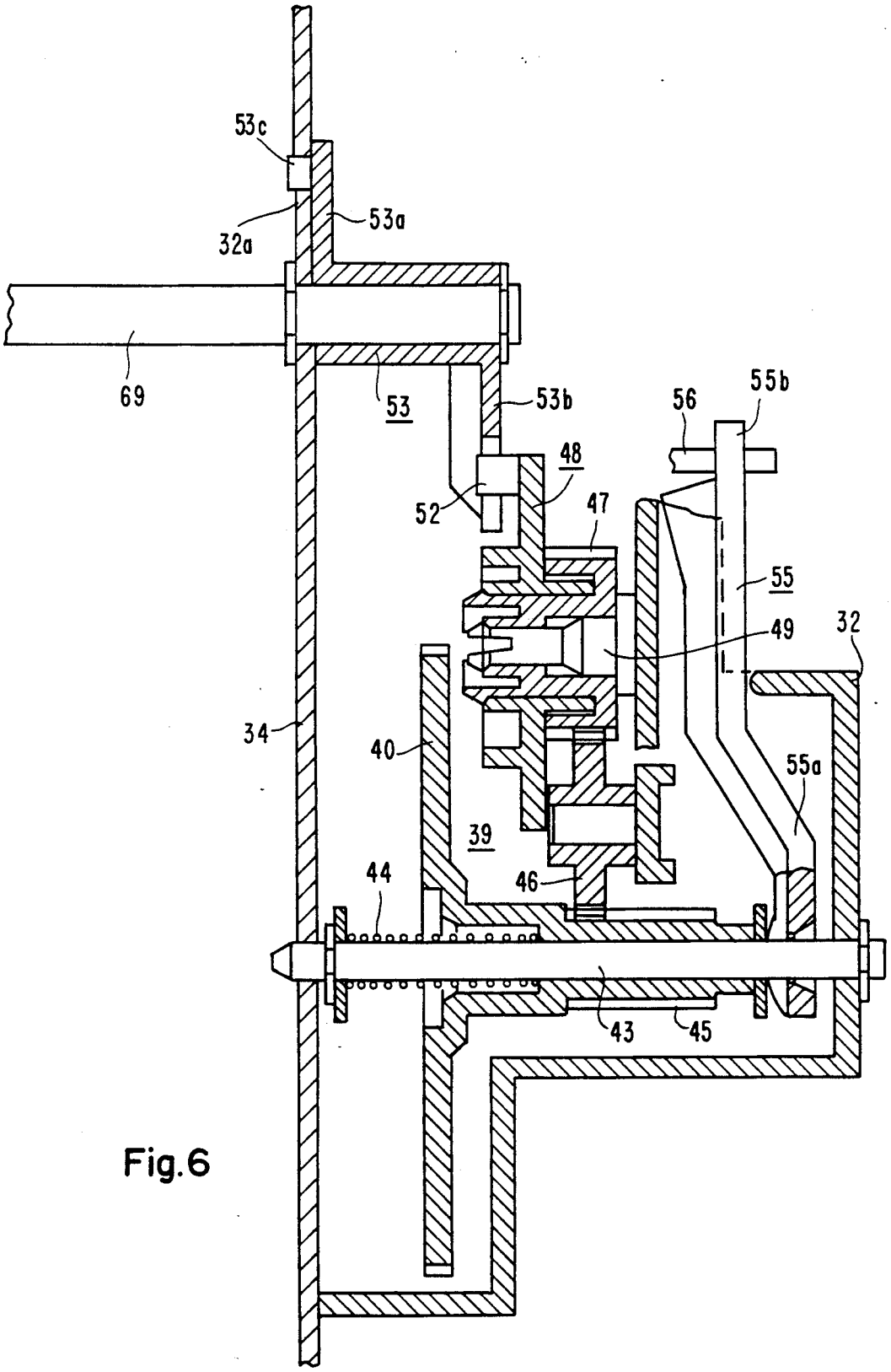
Figure 7:
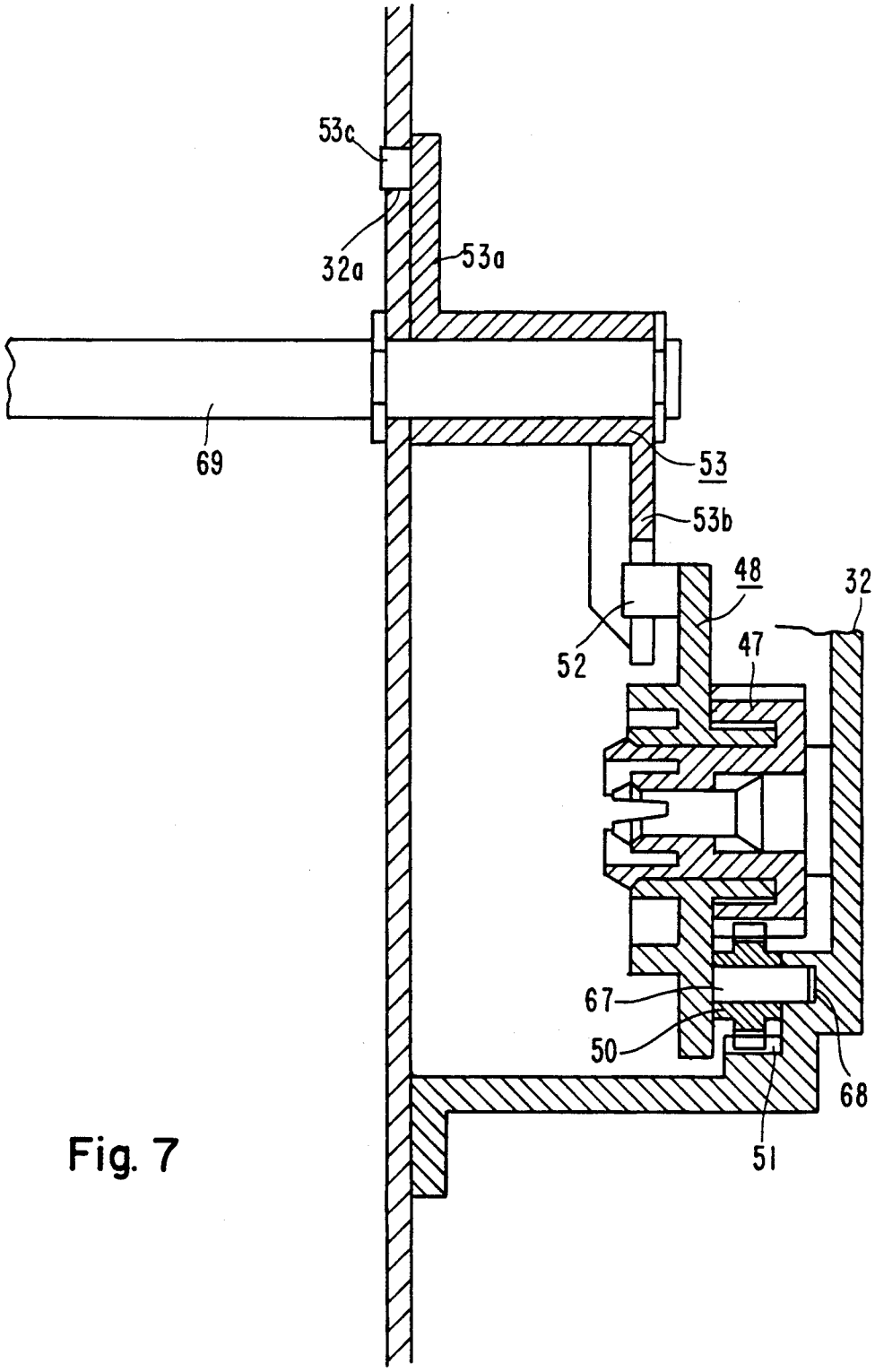
Figure 8:
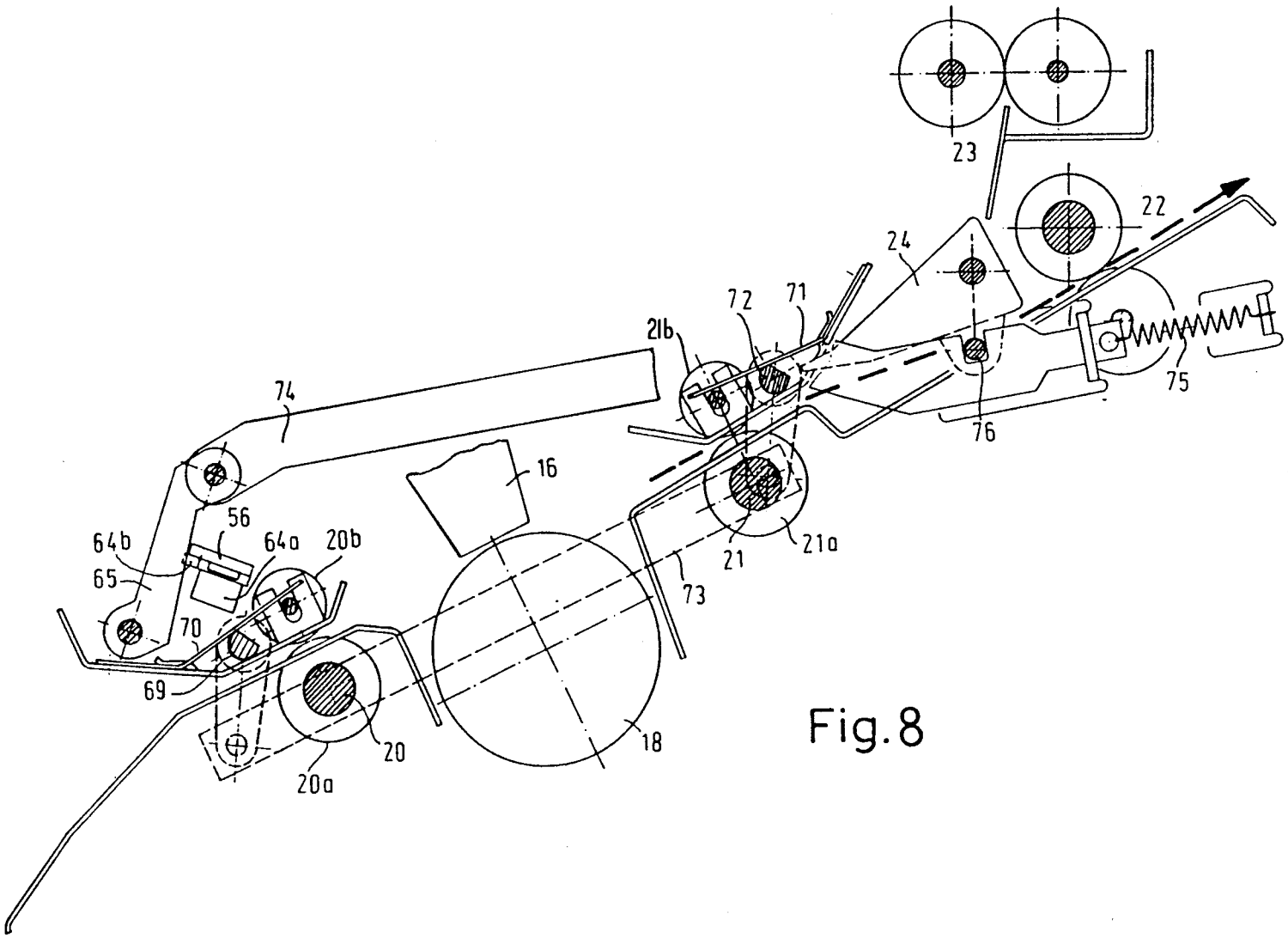
Figure 9:
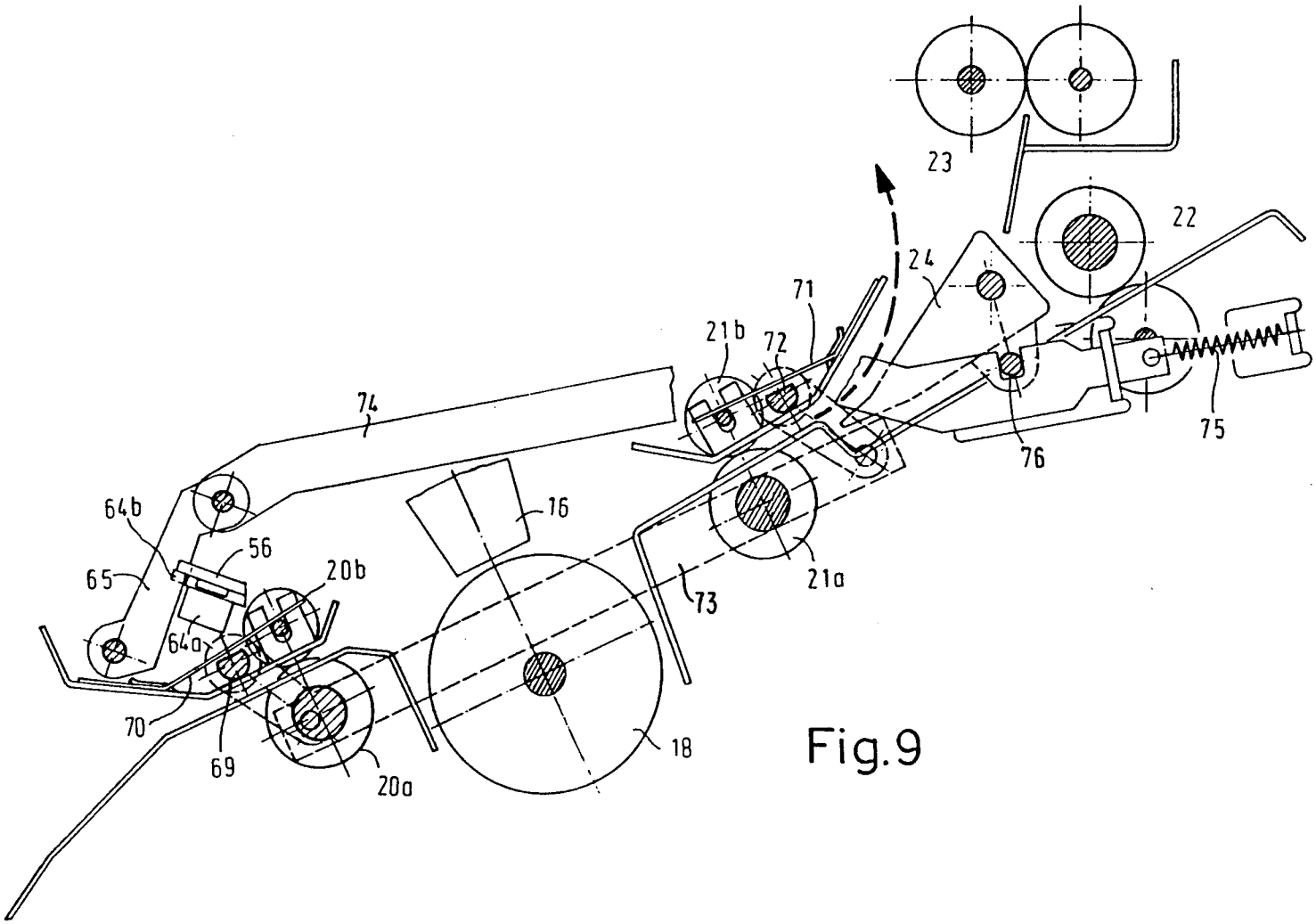

FIGS. 5*a* and *b* show each in a cut side elevation two different positions of a toothed wheel gear of the adjustment gear, FIG. 6 is a sectional view taken along lines VI—VI of FIG. 5*b*, FIG. 7 is a sectional view taken along lines VII—VII in FIG. 5*b*, and in addition a sectional view of a roller lever 53 being shown in the upper part of each of FIGS. 6 and 7, FIG. 8 is a partial side elevation of the printer in the position "endless paper transport", and FIG. 9 shows the same side elevation as FIG. 8, but now in the position "paper sheet transport".

The printer shown in FIGS. 1 and 2 has for feeding paper sheets and endless papers a feeding region located in the front part having a removable supporting plate 10 for forming an entrace 11 for manually feeding paper sheets. Below the supporting plate, the tractor area is located with, for example, two tractors 12 for transporting endless papers. Above the entrance 11, in this case a single removable cassette 13 for automatically feeding paper sheets is arranged. The single cassette includes an individual motor drive and is detachably connected to the printer through hooks 14 and nipples 15. A printing head 16 is displaceable in the direction 17 along a printing roller 18 on a carriage 19. Friction shaft 20 is in front of the printing head 16, relative to the feed path. Friction shaft 21 is behind head 16. The shafts 20 and 21 are continuously driven by a motor drive (not shown). The friction shafts carry friction rollers 20*a*, 21*a*, which cooperate with associated pressure rollers 20*b*, 21*b*. Reference numeral 22 denotes a friction transport for endless papers and reference numeral 23 denotes a friction transport for paper sheets. An adjustable paper path switch 24 serves to direct the paper sheets to a stacker 25 and to direct the endless papers to an ejector port 26 with a tearing edge. The endless papers are supplied from the front side in the direction of the arrow 27 and are transported through the device by the friction transport 22 located behind the printing head 16. Paper sheets are fed manually in the direction of the arrow 28 and automatically from the cassette 13 in the direction of the arrow 29. FIG. 2*a* shows the position of the paper path switch 24 in the endless paper stacking mode and FIG. 2*b* shows in a cut-out section the position of the switch 24 in the paper sheet stacking mode. The adjustment assembly described below senses a path mode position of head 16 and in response to the sensed head position causes the changing over from paper sheet transport to endless paper transport without the operator having to intervene manually. The changeover command is given according to a controlled program, for example through an electronic system 30 arranged in the hindmost lowermost region.

The adjustment assembly 31 is situated in a housing 32 and secured through flanges 33 and screws to the side platform 34 of the printer. The path and mode switching movements, i.e., switching operations, are effected under electronic control by a horizontal movement of the carriage 19 of the printing head through two guiding rods 35, 36 in the directions 17 in combination with the forward and backward paper feed movement of the paper transport tractors 12. Therefore, no electronic switching elements, such as magnets or motors, are required. The adjustment assembly 31 is a complete assembly, which is arranged at the end of the tractors 12 driveshaft 12*a* (FIG. 2*a*) and the friction shaft 20. Assembly 31 comprises a lever mechanism 38 (FIG. 3*a*) and a toothed wheel gear assembly 39 (FIG. 5*a*). The actuation of assembly 31 is effected externally through a ram 37 connected to the carriage 19 and acting upon the lever mechanism 38. The adjustment assembly 31 fulfills three functions, i.e.:

1. coupling-in and coupling-out the endless paper transport, 2. changing over the paper path switch 24 in the paper path, and 3. opening the pressure rollers of the friction drive rollers after the endless paper transport has been coupled in and closing the pressure rollers when the endless paper transport has been coupled out.

The adjustment assembly 31 includes a longitudinally displaceable coupling gear wheel 40, which is arranged between a driving gear wheel 41 secured to the friction shaft 20 and a driving gear wheel 42 secured to shaft 122 of the tractor 12 and can couple in or out the tractor 12 upon actuation. The coupling gear wheel 40 is situated on a shaft 43, which is journalled in the housing 32 and is inserted through a compression spring 44 with the free end into the printing platform 34.

The coupling gear wheel 40 carries according to FIGS. 5*a* and 6 *a* toothing 45, which is interdigitated with a toothed wheel 46. This toothed wheel 46 is interdigitated with a toothed wheel 47, which is journalled together with a follower element 48 on a shaft 49, the toothed wheel 47 being interdigitated with an eccentric toothed wheel 50 journalled on the follower element 48. A toothed wheel segment 51 is incorporated in the housing 32 and this segment is interdigitated with the eccentric toothed wheel segment 50 over a given path length. The follower element 48 is journalled on the toothed wheel 47 through a sliding coupling, that is to say that upon rotation of the toothed wheels 40, 45, 46, 47 the follower element 48 is taken along by frictional forces, but can be stopped at any time without the toothed wheels being blocked. Reference numeral 52 designates a trunnion secured to the follower element 48. As soon as the eccentric toothed wheel 50 engages with the toothed wheel segment 51, a forced rotation of the follower element 48 occurs. Reference numeral 53 designates a roller lever, whose one end 53*a* is passed through a nipple 53*c* into a recess 32*a* of the housing and thus has two end stops and whose other free end 53*b* is bifurcated and serves to temporarily receive the trunnion 52.

In FIG. 3*a*, lever mechanism 38 has a two-armed adjustment lever 55, which is pivotably journalled in the housing 32. Lever 55 has a lever arm 55*a* connected to the shaft 43 and a second lever arm 55*b* connected to a slide 56. The slide 56 is longitudinally displaceable in the housing 32 and is pressed by a spring 57 in the direction 58 towards the housing 32. The slide 56 has a recess 59 on the front side 56*a* and a projection 60, which is arranged on the lower side and cooperates through a slope 61 with a projection 62 on the housing. In FIGS. 4*a–c*, the actuation of the slide 56 is effected through a rotary lever 64, which is journalled on a trunnion 63 of the housing 32 and is in turn actuated by the ram 37 against the force of a return spring 62' and the compression spring 44 (FIGS. 3*a–c*).

In FIGS. 3*a–c*, force is transferred by means of a cylindrical nipple 64*a* on the lower side of the rotary lever 64. Reference numeral 65, FIGS. 4*a–c*, designates a switch lever, which, depending upon the mode of operation, engages either the long front side 56*a* of the slide 56 or its recess 59.

FIGS. 3*a* and 4*a* show the adjustment assembly 31 in the starting position when the endless transport is switched on. The engaged coupling wheel 40 transfers the rotary movement of the continuously driven friction shaft 20 to the square shaft 12*a* of the tractors 12. When now the paper feeding is initiated, the form head of the first inserted endless form is first transported by means of the tractors 12 to the friction drive rollers 20*a*. Subsequently, the form head arrives at the printing head 16, at the friction rollers 21*a* and finally at the transport rollers 22. The latter run about 1.5% more rapidly than the tractor, as a result of which a given paper stress is produced. In order to obtain a defined paper transport in this feed mode, the pressure rollers 20*b*, 21*b* are therefore lifted as soon as the form set reaches the transport rollers 22. The operation for opening the pressure rollers is initiated synchronously with the start of the paper feeding. When the paper feeding is started, the friction shafts 20, 21, 22, 23 are rotated and through the coupled-in toothed wheel 40 the toothed wheels 45, 46, 47, FIG. 6, are also rotated. Since the toothed wheel 47 is connected to the follower element 48 through a snap connection, which acts as a light sliding coupling, the follower element 48 is first taken along and is rotated in the direction 66, FIG. 5*a*. After a short rotary movement (see FIG. 5*a*), the eccentric toothed wheel 50 engages with the stationary toothed segment 51 so that now upon a continued rotary movement the follower element 48 is forcedly taken along. Further, the trunnion 52 is passed under forced control—after it has traversed a given path length, which corresponds to the endless paper transport from the tractors 12 to the transport rollers 22,—into the bifurcated opening of the roller lever 53, rotates the latter upwards into its final position (see FIG. 5*b*) and leaves the bifurcated opening whilst rotating in counterclockwise direction 66. After having reached this position, also the eccentric toothed wheel 50 is again disengaged from the toothed segment 51. The journal 67 of the eccentric toothed wheel 50 is moved during the operation in a curved segment-shaped groove 68 of the housing 32 between the two end stops 68*a* and 68*b* of groove 68 (see FIGS. 5*a*, 5*b* and 7). The roller lever 53 is secured on a D shaft 69, which is journalled in the side platforms of the printer (FIG. 8). In FIG. 8 in the last part of the rotating operation, compression springs 70 of the pressure rollers 20*b* are lifted by the D shaft 69 so that the pressure of the rollers 20*b* on the friction rollers 20*a* is eliminated. The same operation is carried out with the pressure rollers 21*b*, i.e. lifting by compression springs 71 through a D shaft 72, which is connected through a lever rod system 73 to the D shaft 69.

In order to change over from endless paper transport to paper sheet transport, the endless paper after separation along a tearing edge at port 26, FIG. 2*a*, is first moved in a direction reverse direction 28 into a parking position outside the paper path for the paper sheet transport. With this reverse transport, the follower element 48, FIG. 5*b*, is rotated in clockwise direction by tractor 12 shaft 12*a* to the position of FIG. 5*a*, the process described above being effected in opposite sense of direction 28. The roller lever 53 again reaches the position shown in FIG. 5*a*, the D shafts 69 and 72 being rotated back and the pressure springs 70, 71 again being operative FIG. 9. After termination of this reverse transport, the change-over of the adjustment assembly 31 from endless paper transport to paper sheet transport can take place. For this purpose, the carriage 19 with the ram 37 is moved by an electronically initiated movement in the direction of the arrow 17 to the right into a given central position. This exact central position is shown in FIGS. 3*b* and 4*b*. The ram 37 then engages the nipple 64*a* of the rotary lever 64, as a result of which the slide 56 is moved to the right to the position of FIG. 3*b*. The adjustment lever 55 is then actuated by this movement, which moves the coupling toothed wheel 40 against the force of the spring 44 to the left, i.e. out of engagement with the drive wheel 41. As a result, the transfer of the rotary movement between the drive and the tractor is interrupted. The switch lever 65 is connected, as shown in FIG. 8, to a pulling rod 74 and with the endless paper transport described above it is pressed by a tensile spring 75 against the longitudinal front edge 56*a* of the slide 56 (see FIG. 4*a*). The pulling rod 74 has a pivot connection 76 (FIGS. 8 and 9) for adjusting the switch 24 position. With endless paper transport according to FIG. 8, the switch 24 is adjusted upwards.

After adjustment to the position shown in FIGS. 3*b* and 4*b*, the switch lever 65 snaps into the recess 59 and thus adjusts the switch lever 24 downwards to the position shown in FIG. 9 for stacking paper sheets upwards in the stacker 25. After the switch lever 65 has snapped into the recess 59, the slide 56 is locked and the carriage 19 can be displaced to the left, FIG. 4*b*, for carrying out printing commands without the central position of the adjustment assembly 31 being changed.

For change-over from paper sheet transport to endless paper transport, the printer carriage 19, after having been released by an electronic command, is moved to the right into the position shown in FIG. 3*c*. For facilitating the engagement operation, the teeth of the toothed wheels 40, 41 are bevelled. The slide 56 is lifted by the agreement of slope 61 of the projection 60 with protection 62 and reaches the lifted position shown in FIGS. 3*c* and 4*c*. This disengages projection 60 from nipple 60*a*. Since the projection 60 is no longer engaged with the nipple 64*a*, the slide 56 is reset to the left to the start position 69 by the compression spring 44 acting through the coupling toothed wheel 40 which rotates the adjustment lever 55 to the position of FIG. 3*a*. Though in this oblique position, the slide 56 is at its starting position shown in FIG. 3 it is arranged obliquely because projection 60 engages the rotary lever 64 not yet reset (see the position of the slide 56 shown in broken lines in FIG. 4*c*). During this operation, at the same time the switch lever 65 is pushed by a nose 64*b* of the rotary lever 64 out of the recess 59. The slide 56 can therefore slide back if on the one hand during the lifting operation the blocking by the projection 60 is eliminated and if on the other hand the switch lever 65 is pushed out of the recess 59 and therefore the locking is eliminated. After the slide 56 has occupied its oblique position, FIG. 3*c*, the carriage 19 can be moved to the left and can leave the switching position in order to carry out, for example, printing commands. Simultaneously with this movement to the left, FIG. 4*a*, the rotary lever 64 is released by disengagement of the ram 37 from nipple 64*a* and rotated to its starting position shown in FIGS. 3*a* and 4*a* by means of the leaf spring 62. At the beginning of the rotary movement of the rotary lever 64, first the nose 64*b* releases the switch lever 65, which then again engages the slide 56 longitudinal edge 56*a* (FIG. 4*a*). When the rotary lever 64 has reached its final position in FIG. 4*a*, the slide 56 can be pulled from its oblique position by the spring 57 back into its horizontal starting position shown in FIG. 3*a*. When the switch lever 65 again engages the front edge 56*a* of the slide 56, the switch 24 is adjusted through the pulling rod 74 to endless paper transport. Thus, the adjustment assembly 31 is again in the position "endless paper transport" shown in FIGS. 3*a* and 4*a*.

What is claimed is:

1. A device for adjusting a printer comprising a printer head, a paper feed tractor, a paper path switch and a plurality of pressure/friction paper feed roller pairs, each pair having pressed and unpressed states, from a paper sheet transport mode to an endless paper transport mode, and conversely, said device comprising a separate adjustment assembly detachably connected to the printer head and arranged so that upon external actuation acts upon the tractor, the paper path switch and at least one pair of rollers to place the printer in a selected paper sheet and endless paper transport mode.

2. A device as claimed in claim 1 wherein the printer includes a printing roller and a ram secured to the head, the adjustment assembly being arranged laterally on the end of the printing roller, said adjustment assembly being activated by engagement of the ram therewith upon displacement of the printing head.

3. A device as claimed in claim 1 wherein said device is arranged so that in:

a) a starting position of the adjustment assembly, in which the tractor is coupled in, the pressure rollers are first pressed and are then placed in the unpressed state with delay after a starting time and the path switch is in the position "endless paper transport", and b) a defined central position of the head, in which the tractor is coupled out, the pressure rollers are in the pressed state and the path switch is in the position "paper sheet transport".

4. A device as claimed in claim 2 wherein the adjustment assembly is set by a single movement of the ram from a starting position to a central position and reset by a renewed movement from the central position to the starting position.

5. The device as claimed in claim 2 wherein the adjustment assembly comprises:

a) a lever mechanism including a switch lever for adjusting the mode of said path switch, and including a toothed coupling gear wheel, a motor drive gear wheel, and a spring loaded adjustment lever for selectively coupling the coupling gear wheel to the drive gear wheel and to the tractor, and b) a follower element having pressure roller coupling and decoupling positions responsive to the operation of said coupling gear wheel for placing said element in a selected one of said latter positions.

6. The device of claim 5 wherein the lever mechanism includes a slide having first and second ends and adjustable in first and second directions, a spring loaded rotary lever adjacent to the first end, said slide being spring loaded transverse said directions and an adjustment lever pivotally coupled to the slide at the first end, said slide having a front side extending between said ends and a recess in said front side and second end, said switch lever for selectively engaging said recess, said slide having a lower side and including a projection depending from the lower side and having a first wall and a second sloped wall, said lower side and first wall for selectively engaging said rotary lever when the slide is urged toward said rotary lever in said first direction and means for engaging said sloped wall when the slide is urged in said second direction to disengage said projection first wall from said rotary lever.

7. A device as claimed in claim 6 wherein the rotary lever has a nose for selectively engaging the switch lever and a cylindrical nipple for engaging the projection first wall upon engagement of the slide with the ram.

8. A device as claimed in claim 7 wherein said device is arranged so that in:

a) a starting position of the adjustment assembly, in which the tractor is coupled in, the pressure rollers are first pressed and are then placed in the unpressed state with delay after a starting time and the path switch is in the position "endless paper transport", and b) a defined central position of the head, in which the tractor is coupled out, the pressure rollers are in the pressed state and the path switch is in the position "paper sheet transport".

9. A device as claimed in claim 7 wherein the adjustment assembly is set by a single movement of the ram from a starting position to a central position and reset by a renewed movement from the central position to the starting position.

10. The device of claim 5 wherein said follower element is disc shaped, said device including at least one gear wheel coupled to and driven by said coupling gear wheel, said element being slidably coupled to said at least one gear wheel and being rotatably driven by said slidable couple in response to rotation of said at least one gear wheel, said device further including 1) an eccentric gear wheel journaled eccentrically on the follower element for rotation with the follower element and 2) a fixed gear segment positioned to selectively engage said eccentric gear wheel as the latter is moved by the element through a given path length defined by said segment.

11. A device as claimed in claim 5 wherein the adjustment assembly is set by a single movement of the ram from a starting position to a central position and reset by a renewed movement from the central position to the starting position.

12. A device as claimed in claim 6 wherein the adjustment assembly is set by a single movement of the ram from a starting position to a central position and reset by a renewed movement from the central position to the starting position.

13. A device as claimed in claim 6 wherein the adjustment assembly is set by a single movement of the ram from a starting position to a central position and reset by a renewed movement from the central position to the starting position.

14. A device as claimed in claim 10 wherein the adjustment assembly is set by a single movement of the ram from a starting position to a central position and reset by a renewed movement from the central position to the starting position.

15. A device as claimed in claim 5 wherein said device is arranged so that in:

a) a starting position of the adjustment assembly, in which the tractor is coupled in, the pressure rollers are first pressed and are then placed in the unpressed state with delay after a starting time and the path switch is in the position "endless paper transport", and b) a defined central position of the head, in which the tractor is coupled out, the pressure rollers are in the pressed state and the path switch is in the position "paper sheet transport".

16. A device as claimed in claim 6 wherein said device is arranged so that in:

a) a starting position of the adjustment assembly, in which the tractor is coupled in, the pressure rollers are first pressed and are then placed in the unpressed state with delay after a starting time and the path switch is in the position "endless paper transport", and b) a defined central position of the head, in which the tractor is coupled out, the pressure rollers are in the pressed state and the path switch is in the position "paper sheet transport".

17. A device as claimed in claim 10 wherein said device is arranged so that in:

a) a starting position of the adjustment assembly, in which the tractor is coupled in, the pressure rollers are first pressed and are then placed in the unpressed state with delay after a starting time and the path switch is in the position "endless paper transport", and b) a defined central position of the head, in which the tractor is coupled out, the pressure rollers are in the pressed state and the path switch is in the position "paper sheet transport".

18. In a print apparatus including a print head secured to a carriage which displaces along an elongated print roller, a paper feed tractor for feeding endless paper for printing by said print head, means for feeding sheet paper for printing by said print head including a plurality of roller pairs, said pairs each including a friction drive roller and a pressure roller urged against the drive roller, paper path switch means for switching the paper paths of said apparatus between paper sheet transport and endless paper transport modes, a device for switching said modes comprising:

means for selectively placing the print head in a paper transport mode switch position;

sense means for sensing the paper transport mode switch position of said head; and means responsive to the sensed mode switch position of said head for selectively placing said tractor, means for feeding sheet paper and switch means in said sheet and endless paper transport modes.

19. The device as claimed in claim 18 wherein said means for sensing includes a ram secured to said carriage and lever means responsive to the engagement thereof with said ram, said lever means having a first condition manifesting an endless paper transport mode and a second condition manifesting a sheet transport mode, said ram for selectively placing said lever means in said first and second conditions.

20. The device of claim 19 wherein said means responsive to the sensed position includes actuation means responsive to the condition of said lever means for placing the paper path switch means, roller pairs and tractor in a respective feed mode corresponding to the condition of said lever means.

21. The device of claim 20 including a system drive roller, said actuation means includes gear means responsive to the condition of said lever means for selectively coupling and decoupling the tractor to said system drive roller, selectively coupling and decoupling the presseure roller from the friction drive roller and for selectively placing the path switch in a path mode corresponding to the coupling state of said tractor and pressure roller such that in the first condition the tractor is coupled, the switch is in the endless feed mode, and the pressure roller is decoupled and conversely, in the second condition, the switch is in the sheet feed mode, the tractor is decoupled and the pressure roller is coupled to the friction drive roller.

22. The device of claim 21 wherein said gear means is arranged such that reverse displacement of the paper feed tractor in response to displacement of the endless paper coupled thereto, said pressure roller is decoupled from the friction drive roller in the sheet feed mode and upon engagement of said lever means by said ram, said lever means is switched from the second condition to the first condition and said tractor and path switch are placed in said endless feed mode.

23. In a print apparatus including a print head secured to a carriage which displaces along an elongated print roller, a paper feed tractor for feeding endless paper for printing by said print head, means for feeding sheet paper for printing by said print head including a plurality of roller pairs, said pairs each including a friction drive roller and a pressure roller urged against the drive roller, paper path switch means for switching the paper paths of said apparatus between paper sheet transport and endless paper transport modes, a method for switching said modes comprising:

selectively placing the print head in a paper transport mode switch position;

sensing the paper transport mode switch position of said head; and in response to sensing the mode switch position of said head, selectively placing said tractor, means for feeding sheet paper and switch means in said sheet and endless paper transport modes.

24. The method of claim 23 wherein said selectively placing the print head includes sequentially placing the head in said switch position to successively switch modes.

25. The method of claim 24 including the step of reversing the movement of endless paper in said apparatus to reset the pressure roller to the endless feed mode.

* * * * *